US008820134B2

(12) United States Patent
Cabianca

(10) Patent No.: US 8,820,134 B2
(45) Date of Patent: Sep. 2, 2014

(54) MECHANISM FOR MOVING THE BLADE HOLDER OF A PANEL BENDER FOR BENDING SHEET METAL

(75) Inventor: Pietro Cabianca, Casale di Scodosia (IT)

(73) Assignee: Finn-Power Italia S.R.L., Cologna (IT)

( * ) Notice: Subject to any disclaimer, the term of this patent is extended or adjusted under 35 U.S.C. 154(b) by 0 days.

(21) Appl. No.: 14/007,687

(22) PCT Filed: Mar. 27, 2012

(86) PCT No.: PCT/EP2012/055444
§ 371 (c)(1),
(2), (4) Date: Sep. 26, 2013

(87) PCT Pub. No.: WO2012/130859
PCT Pub. Date: Oct. 4, 2012

(65) Prior Publication Data

US 2014/0013818 A1 Jan. 16, 2014

(30) Foreign Application Priority Data

Mar. 30, 2011 (IT) ..... VR2011A0061

(51) Int. Cl.
*B21D 5/04* (2006.01)
*B21D 11/00* (2006.01)

(52) U.S. Cl.
CPC ..... *B21D 5/04* (2013.01)
USPC ..... 72/322; 72/319; 72/323; 72/450; 72/454

(58) Field of Classification Search
USPC ..... 72/306, 316, 319, 322, 323, 450, 454, 72/455; 29/243.58
See application file for complete search history.

(56) References Cited

U.S. PATENT DOCUMENTS 4,356,716 A * 11/1982 Aschauer ..... 72/322
4,411,148 A * 10/1983 Aschauer et al. ..... 72/306

(Continued)

FOREIGN PATENT DOCUMENTS

WO 9316822 A1 9/1993
WO 9846380 A1 10/1998
WO 2006043292 A1 4/2006

OTHER PUBLICATIONS

International Search Authority, Search Report for International Application PCT/EP2012/055444, Jun. 22, 2012 (EPO), 1 page, The Hague, Netherlands.

*Primary Examiner* — David B Jones
(74) *Attorney, Agent, or Firm* — Ference & Associates LLC

(57) ABSTRACT

A panel bender (10) designed for making bends on sheet metal sheets (13) comprises a substantially C-shaped main structure (11) equipped with a fixed element (12) and a mobile element (14) designed to support and clamp in a preset position a sheet metal sheet (13) to be bent, and also comprises a substantially C-shaped blade holder structure (16) connected to the main structure (11) and mobile in space inside this by means of a series of vertical guides (15) at right angles to the plane of the sheet metal sheet (13) to be bent. The blade holder structure is equipped with an upper blade (26) and a lower blade (27) designed to enter into contact with the surface of the sheet metal sheet (13) to be bent clamped between the mobile and fixed elements (12, 14) of the main structure (11) and to deform the sheet metal sheet by means of a movement with a programmable trajectory. The blade holder structure (16) also comprises respective pairs of upper (18) and lower (18') wedge-shaped slides connected to the vertical guides (15) and running along these, the slides (18, 18') having counteropposing faces (30, 30') inclined at a preset angle; each upper (18) and lower (18') wedge-shaped slide is also connected to the main structure (11) by a respective linear actuator (32, 32') controlled hydraulically or electro-mechanically. The movements of the linear actuators (32, 32'), which cause the movements of the wedge-shaped slides (18, 18') in the respective vertical (Y) and horizontal (X) directions, are independent and synchronized by a numeric control system.

12 Claims, 6 Drawing Sheets

(56) References Cited

U.S. PATENT DOCUMENTS

| | | | | |
|---|---|---|---|---|
| 4,843,862 | A * | 7/1989 | Salvagnini | 72/319 |
| 5,694,801 | A * | 12/1997 | Takahashi et al. | 72/319 |
| 6,196,041 | B1 * | 3/2001 | Codatto | 72/323 |
| 6,470,727 | B1 * | 10/2002 | Kunze | 72/323 |
| 8,006,531 | B2 * | 8/2011 | Patuzzi et al. | 72/306 |
| 8,312,752 | B2 * | 11/2012 | Patuzzi | 72/306 |
| 2009/0126434 | A1 * | 5/2009 | Kawasaki | 72/20.2 |

* cited by examiner

MECHANISM FOR MOVING THE BLADE HOLDER OF A PANEL BENDER FOR BENDING SHEET METAL

TECHNICAL FIELD

This invention relates to a traversing mechanism for the blade holder structure of a panel bender for bending sheet metal sheets.

More specifically, this invention relates to a mechanism in which the blade holder structure is moved by a double pair of wedge-shaped slides slidable on linear guides applied to the main structure of the panel bender.

The invention is mainly applied in the field of panel benders for making profiles starting from metal sheets.

BACKGROUND ART

Prior art panel benders are known which operate the process for bending a sheet of sheet metal using a pair of blades mounted on a substantially C-shaped structure and which may be hydraulically or electro-mechanically operated.

In this type of machine, a sheet metal sheet to be bent is clamped by a device, the so-called presser or pressure bar, which moves in a direction at right angles to the plane of the metal sheet itself and it is compressed against a fixed part, the so-called counterblade.

Each of the two blades, upper and lower, describes a curvilinear trajectory in the two degrees of horizontal (X) and vertical (Y) freedom, in directions parallel and at right angles to, respectively, the plane of the metal sheet.

During the movement the blade enters into contact with the metal sheet and deforms it plastically. The trajectory may be fixed or in some cases programmed with numerical control systems (NCS), by interpolation of the two axes X, Y.

The prior art architectures of the kinematic chains of the blade holder are as follows:

a) articulated pentalateral with two degrees of freedom in which the movement elements are hydraulic cylinders which extend in length;

b) articulated pentalateral in which the movement elements are cranks operated by an electric motor coupled with precision reduction gear for high torques. This solution is described in patent document WO-A-2006/043292;

c) wedge-shaped slide coupled with the blade holder structure through a plane inclined at a suitable angle, in which the movement at right angles to the plane of the metal sheet is provided by a linear actuator which moves the blade holder together with the above-mentioned slide; the movement in the direction parallel to the metal sheet is provided by the relative movement between the blade holder and the slide itself. This solution is described in patent document Wo-A-98/046380;

The main drawback of the first two solutions a) and b) derives from the kinematic complexity of the mechanism, which requires the development of inverse kinematic calculations, that may often only be solved with the use of particular algorithms.

Another drawback often derives from the reduced number of supports and constraints of the C-shaped structure of the blade holder which deforms under the bending load, in addition to the fact that the blades move in a non-parallel manner with a roto-translatory motion These limitations are partly superseded by the third solution c), which however has an economic limitation in the making of an electro-mechanical operating system with screw, gearmotor and motor.

The bending load is supported completely by the linear actuator which moves the C-shaped structure of the blade holder in a direction at right angles to the plane of the metal sheet.

In the direction parallel to the plane of the metal sheet the load is reduced thanks to the interposing of the wedge-shaped slide.

DESCRIPTION OF THE INVENTION

This invention proposes to overcome the typical drawbacks and disadvantages of the prior art, and to provide a traversing mechanism which allows a curvilinear trajectory of the two bending blades to be obtained by means of exclusively rectilinear movements and excluding rotations of the blades.

This is achieved by means of a traversing mechanism for the blade holder structure of a panel bender having the characteristics described in claim 1.

The dependent claims describe particularly advantageous embodiments of the mechanism according to this invention.

The traversing mechanism for the blade holder structure of a panel bender according to this invention allows the loads resulting from the bending process to be shared equally on all the linear traversing devices, so as to make them more efficient and therefore less expensive.

The use of numerically controlled electromechanical systems is therefore justified, comprising an electric motor, a precision, epicycloid gear motor and a recirculating ball screw.

The equal distribution of the loads on the actuators is accompanied by a similar distribution of the constraining reactions on the supports of the C-shaped blade holder structure, in such a way that the deformations are minimized and, consequently, the quality of the items produced is improved.

The homogeneous size of the linear actuators favours the modularity and low cost of the panel bender in general, such that longer or shorter machines may be obtained by adding or removing pairs of wedge-shaped slides, according to the length of the parts to be made.

DESCRIPTION OF THE DRAWINGS

The invention is described below with reference to the attached drawings, provided as a non-binding example, in which.

DESCRIPTION OF ONE EMBODIMENT OF THE INVENTION

Figure 1:
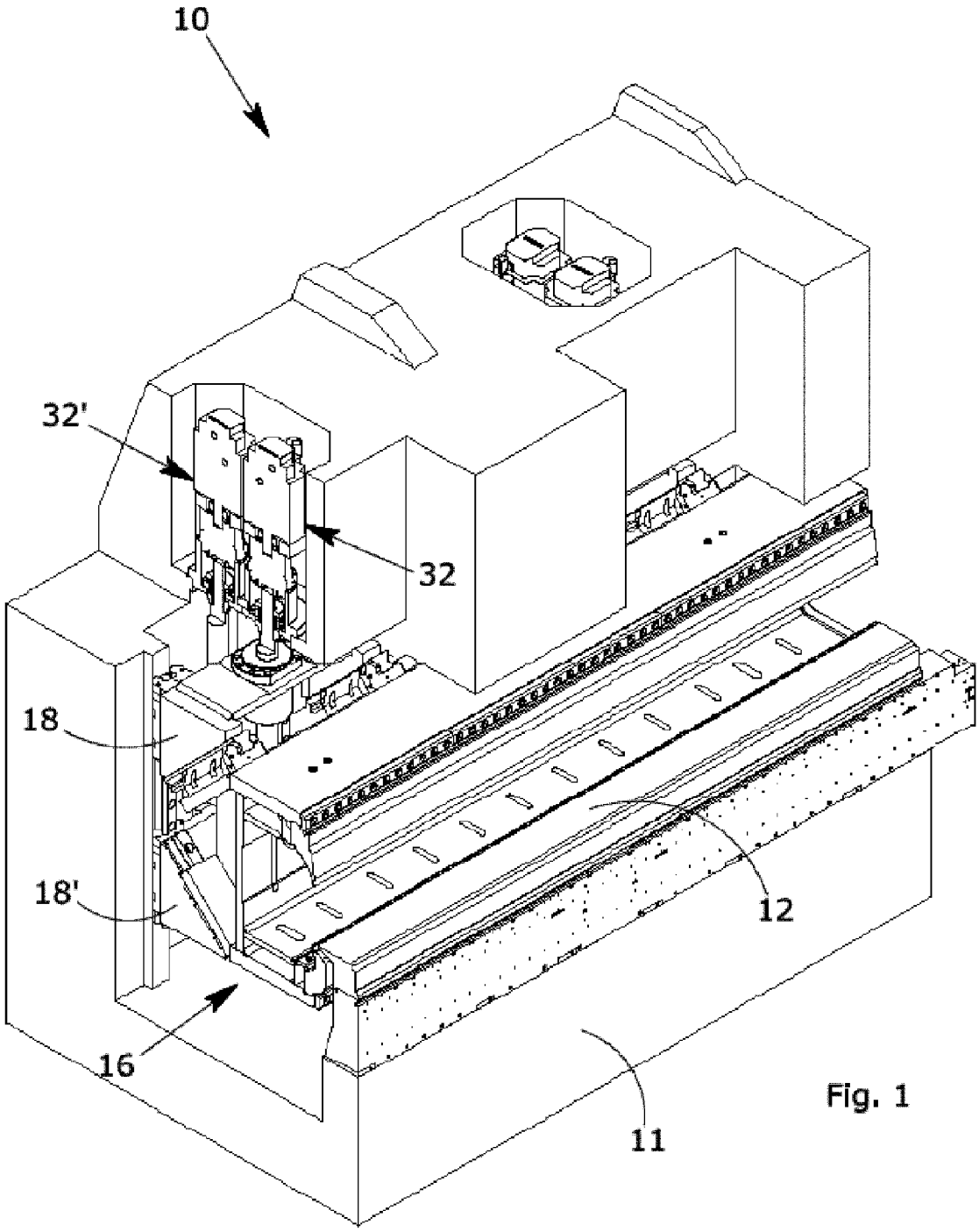
FIG. 1 shows a perspective view of a panel bender according to this invention, without the pressure bar device which is normally mounted in the front part of the machine.

FIG. 1 shows a panel bender 10 for bending sheet metal sheets comprising a substantially C-shaped main structure 11 equipped with a fixed element 12 called a counterblade, designed to support a sheet metal sheet 13 (see FIGS. 8 and 9) to be bent resting on the counterblade and clamped in position by a pressing element 14 (see FIGS. 8 and 9) slidable on vertical guides belonging to the main structure 11.

Figure 2:
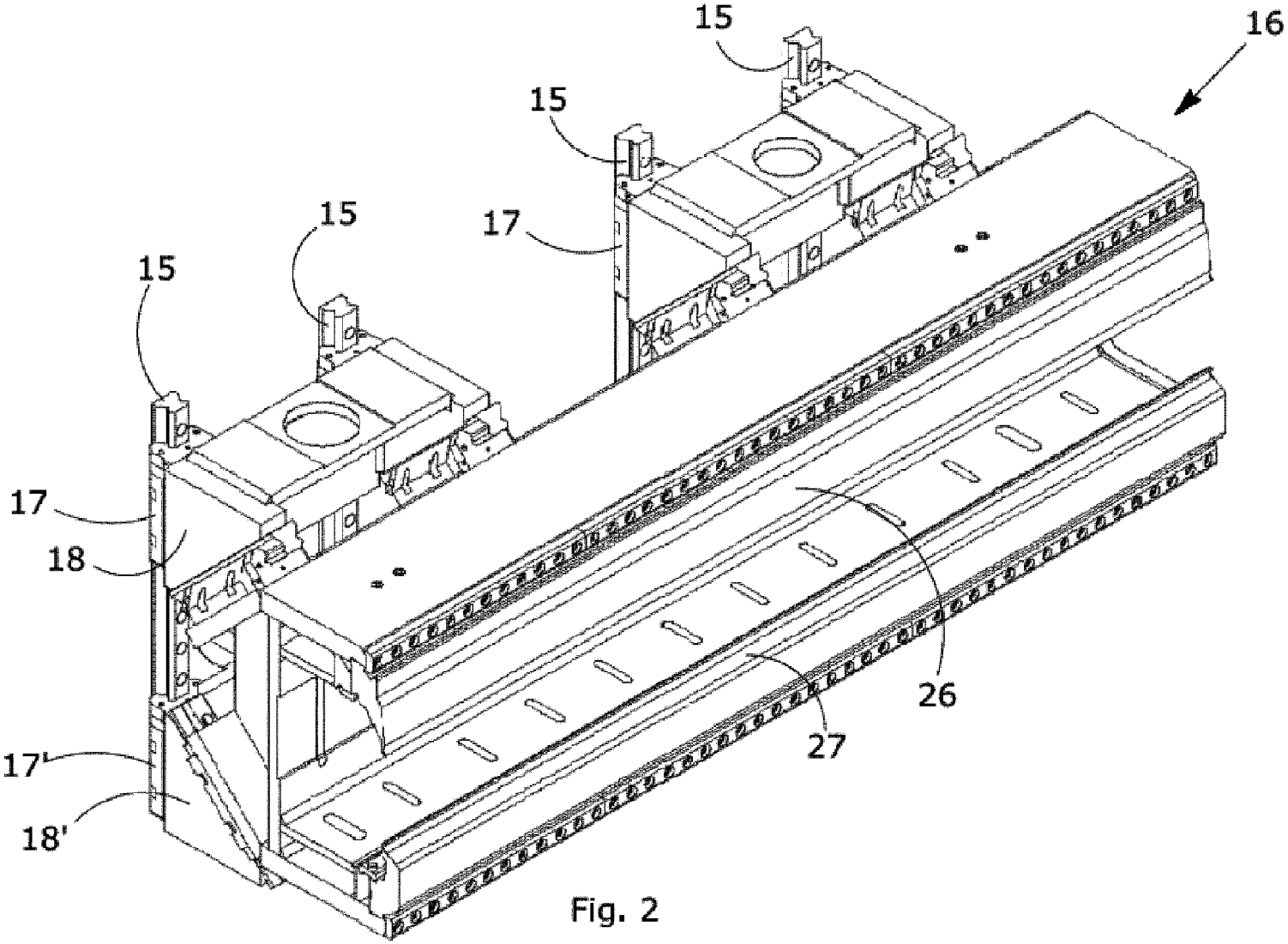
FIG. 2 shows a perspective view of the movement unit of the C-shaped blade holder with counteropposing double pair of wedges according to this invention.

The main structure 11 is equipped with vertical guides 15 (see FIG. 2) designed to allow movement in a vertical direction of a C-shaped blade holder structure 16. The guides 15, which are at right angles to the plane of the sheet metal sheet to be bent and which, for example, are grouped together in a right pair and a left pair, are conveniently spaced along the length of the panel bender 10.

According to this invention, two upper 18 and lower 18' wedge-shaped slides with counteropposing angles each equal to 45° slide on each pair of guides.

Figure 3:
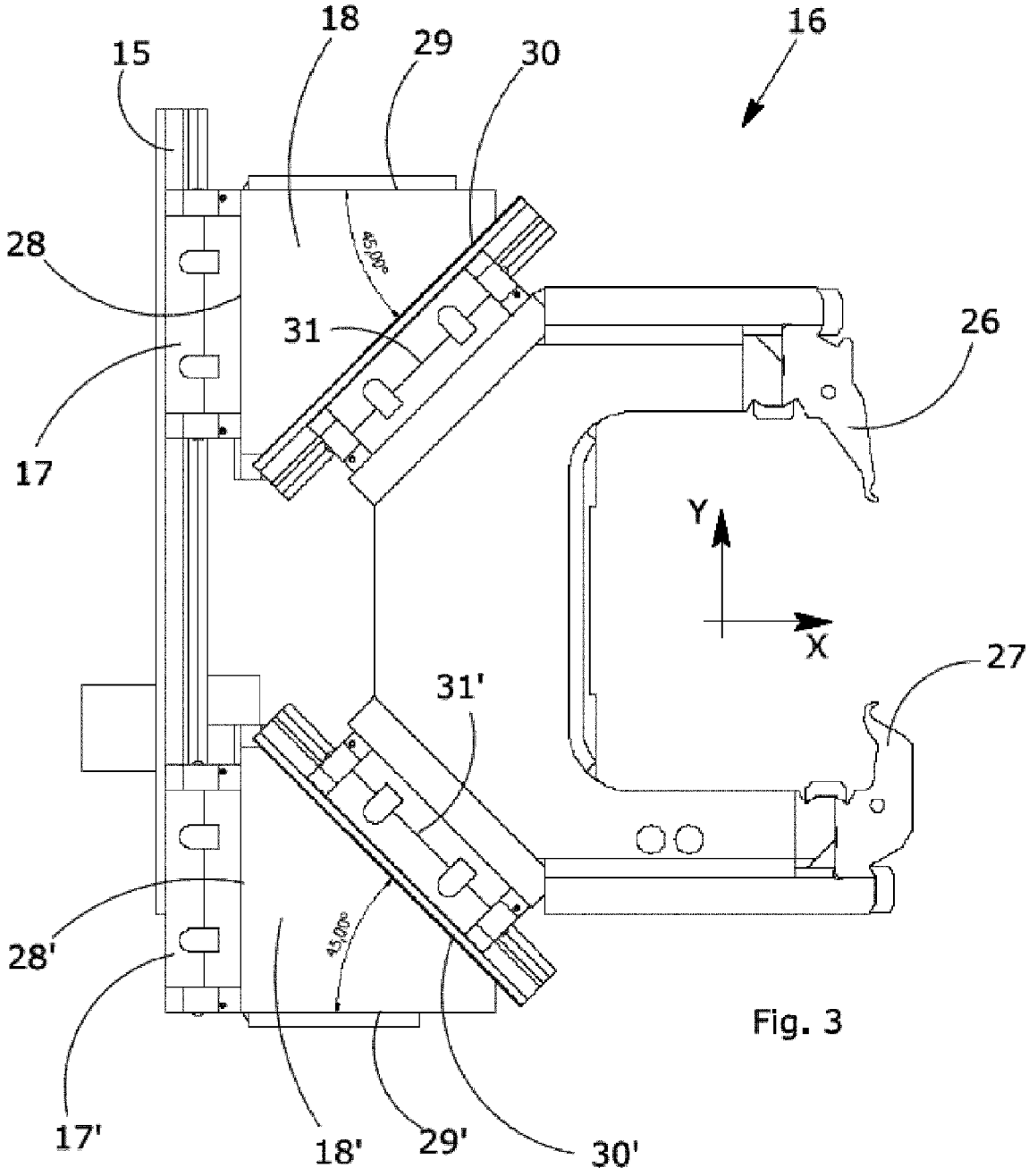
FIG. 3 shows a front view of the C-shaped blade holder unit comprising a pair of wedge-shaped slides according to this invention.

Each wedge-shaped slide 18, 18' (see FIG. 3) is fixed to the above-mentioned vertical guides 15 by sliding blocks 17, 17' with recirculating rollers, for example of the INA RUE65E type, and comprise a vertical face 28, 28', connected to the sliding blocks 17, 17', a horizontal face 29, 29', and a face 30, 30", inclined at 45°, connected to the C-shaped blade holder structure by sliding blocks 31, 31' with recirculating rollers.

For this reason, the blade holder 16 is connected to the main structure 11 by two pairs of counteropposing wedge-shaped slides 18, 18' inclined at 45° and has, through the respective sliding blocks 17, 17' and 31, 31' with recirculating rollers, two degrees of freedom in the directions, respectively, parallel to the plane of the sheet metal sheet to be bent (X) and at right angles (Y) to the plane.

The blade holder 16 comprises an upper bending blade 26 and a lower bending blade 27.

According to this invention, each wedge-shaped slide 18, 18' is fixed to a linear actuator 32, 32', consisting, for example, of a screw, an axial-radial bearing, a gear motor and an electric motor.

In the case illustrated in the drawings, each wedge-shaped slide 18, 18' is connected to the scroll of a respective recirculating ball screw 22, 22' for high loads, for example of the UMBRA SF80x40 type with two recirculating ball screws (see FIGS. 4 to 9).

Each screw 22, 22' is fixed to the upper part of the main structure 11 by a relative preloaded axial-radial bearing 23, 23', for example of the INA ZARF or ZARN type, housed in an adequate support.

Each screw 22, 22' is rotated by a respective precision, epicycloid gear motor 24, 24', for example of the Alfa TP110 type, connected to a respective electric motor 25, 25', normally of the synchronous type.

The two wedge-shaped slides 18, 18' of each pair, right and left, are moved by the respective recirculating ball screws 22, 22' and both slide along the guides 15 fixed to the inner wall of the main structure 11.

According to this invention, by combining the speed and direction of movement of each pair of screw axes, interpolated movements are obtained in the two degrees of freedom X and Y of the blade holder structure 16.

Each pair of recirculating ball screws 22, 22', on the right and left, respectively, transmit to the blade holder structure (1), through the wedge-shaped slides 18, 18' positioned at an angle of 45°, the resultant of the forces developed by each screw, both when the blade holder 16 moves at right angles (axis Y) to the plane of the sheet metal sheet 13, and when the blade holder 16 moves parallel to the plane of the sheet metal sheet 13, along axis X.

There is, therefore, a law of transformation between the two parallel linear axes applied to each pair of wedge-shaped slides 18, 18', and the two axes which constitute the two degrees of freedom of the blade holder structure 16.

This law may be used to control and program the trajectories of any shape for the motion of the bending blades 26, 27, which operate the sheet metal sheet 13 deformation process.

The two pairs of parallel linear axes 22, 22', right and left, respectively, are controlled by electrical coupling, for example with gantry technology, to allow precise parallel movement of the blade holder structure 16.

Small displacements between the two sides, right and left, are permissible and possibly useful for correcting any geometrical errors of parallelism of the blades 26, 27 relative to the plane of the sheet metal sheet 13 to be bent.

Operatively (see FIGS. 4 to 7), the two counteropposing wedge-shaped slides 18, 18' move between two end positions along the direction at right angles to the plane of the sheet metal sheet to be bent (axis Y), in such a way that their concordant and synchronised movement causes a movement of the blade holder 16 in a direction at right angles to the sheet metal sheet.

However, the discordant and synchronous movement of the wedge-shaped slides 18, 18' generates a movement of the blade holder 16 in the direction parallel to the plane of the sheet metal sheet 13 to be bent, along axis X.

The combined direction and speed of movement of the wedge-shaped slides of each pair causes a movement of the blade holder 16 which may be programmed as desired, in the directions at right-angles and parallel to the sheet metal sheet 13 to be bent (axes X and Y).

The various positions which may be assumed by the blades 26, 27 are illustrated in FIGS. 4 to 7.

Figure 5:
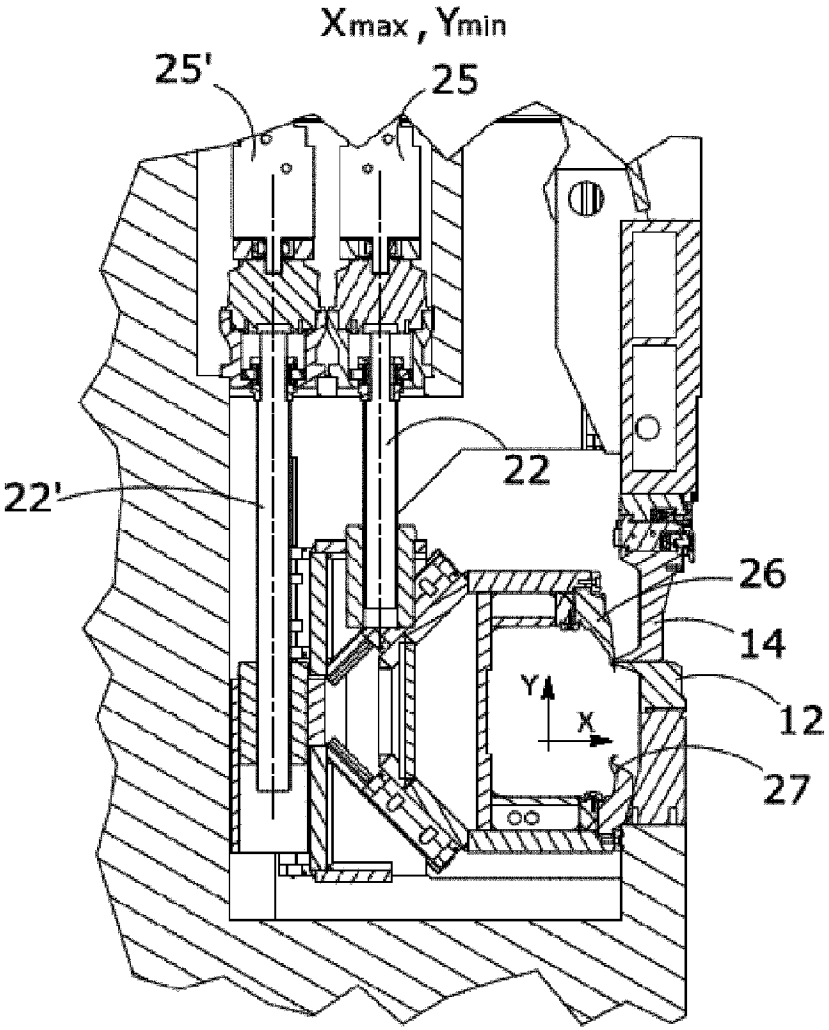
FIGS. 4 to 7 show four end movement positions of the blade holder unit, along the respective horizontal (X) and vertical (Y) axes.
Figure 4:
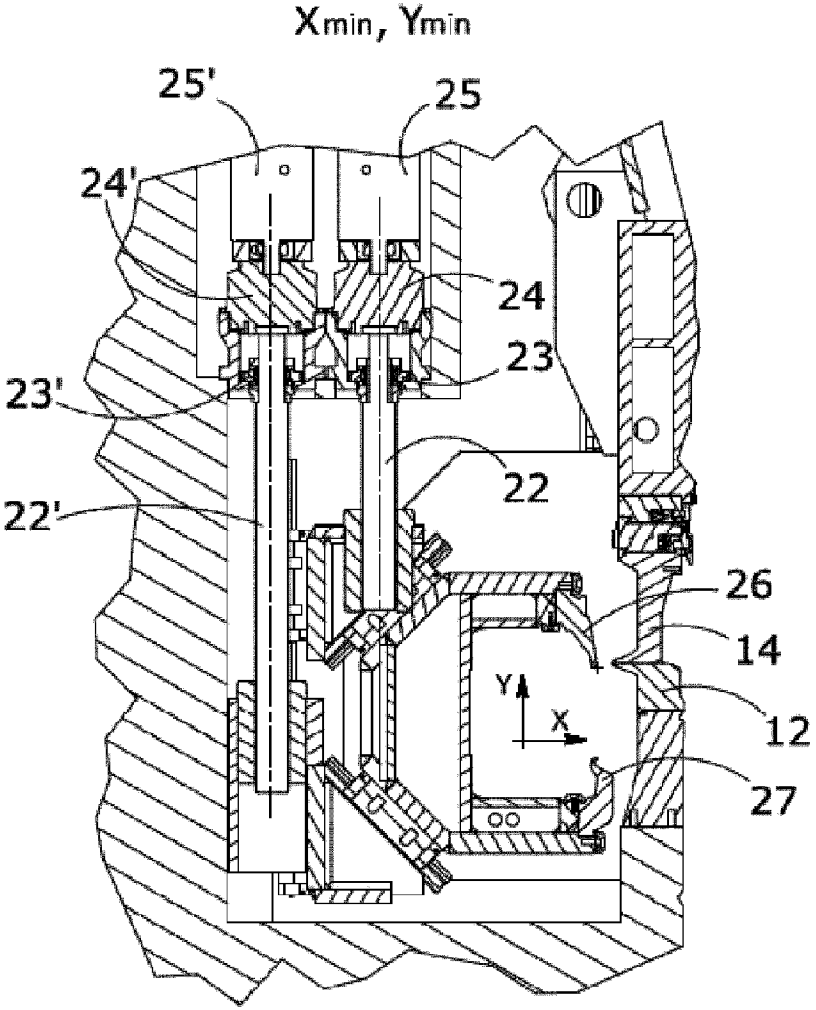
Figure 7:
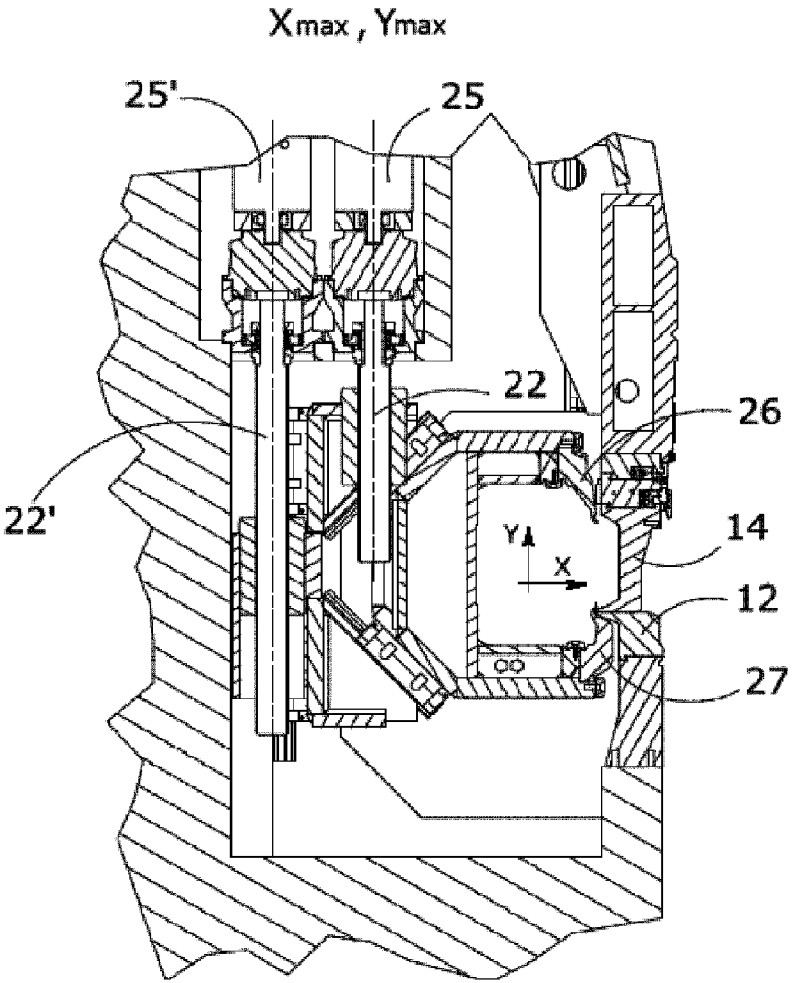
Figure 6:
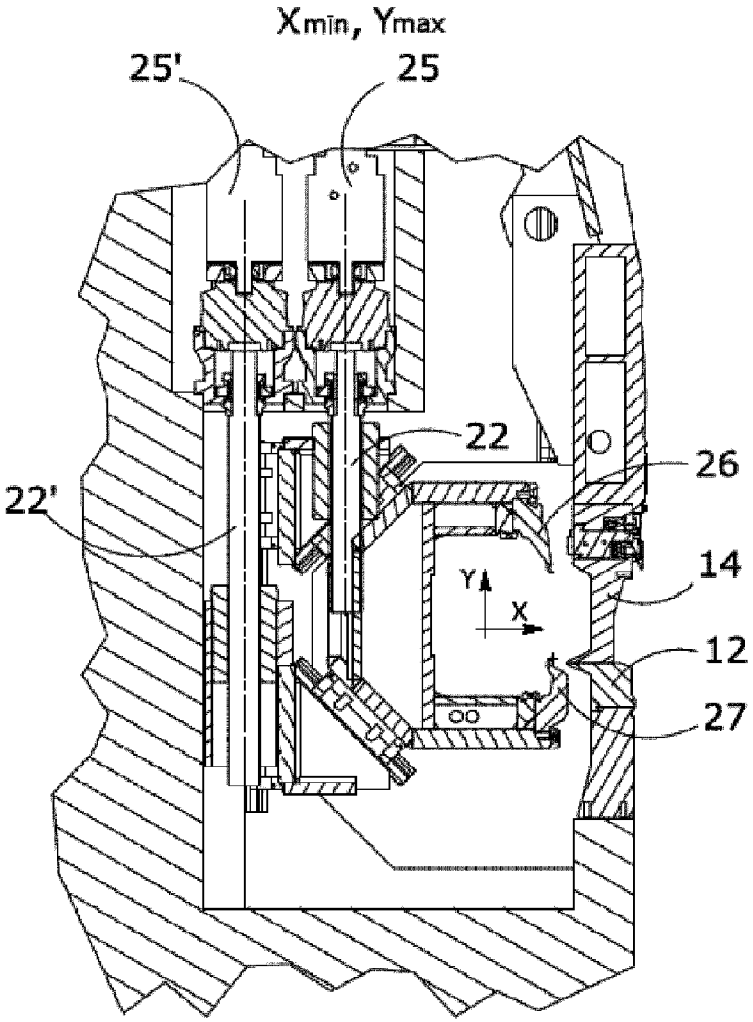

More specifically:

FIG. 4 shows the position ($X_{min}$, $Y_{min}$) of the upper blade 26 furthest away from the counterblade 12 on the horizontal plane, and lowered completely on the vertical plane;

FIG. 5 shows the position ($X_{max}$, $Y_{min}$) of the upper blade 26 nearest the counterblade 12 on the horizontal plane, and lowered completely on the vertical plane;

FIG. 6 shows the position ($X_{min}$, $Y_{max}$) of the lower blade 27 furthest away from the counterblade 12 on the horizontal plane, and raised completely on the vertical plane;

FIG. 7 shows the position ($X_{max}$, $Y_{max}$) of the lower blade 27 nearest the counterblade 12 on the horizontal plane, and raised completely on the vertical plane;

As mentioned above, these positions are obtainable by suitable synchronous and, respectively, concordant or discordant, rotation of the recirculating ball screws 22, 22'. An adequate programming therefore allows any position of the bending blades 26, 27 to be obtained, located between the positions illustrated in FIGS. 4 to 7, and to therefore obtain any type of angle for bending the sheet metal sheet 13.

Figure 9:
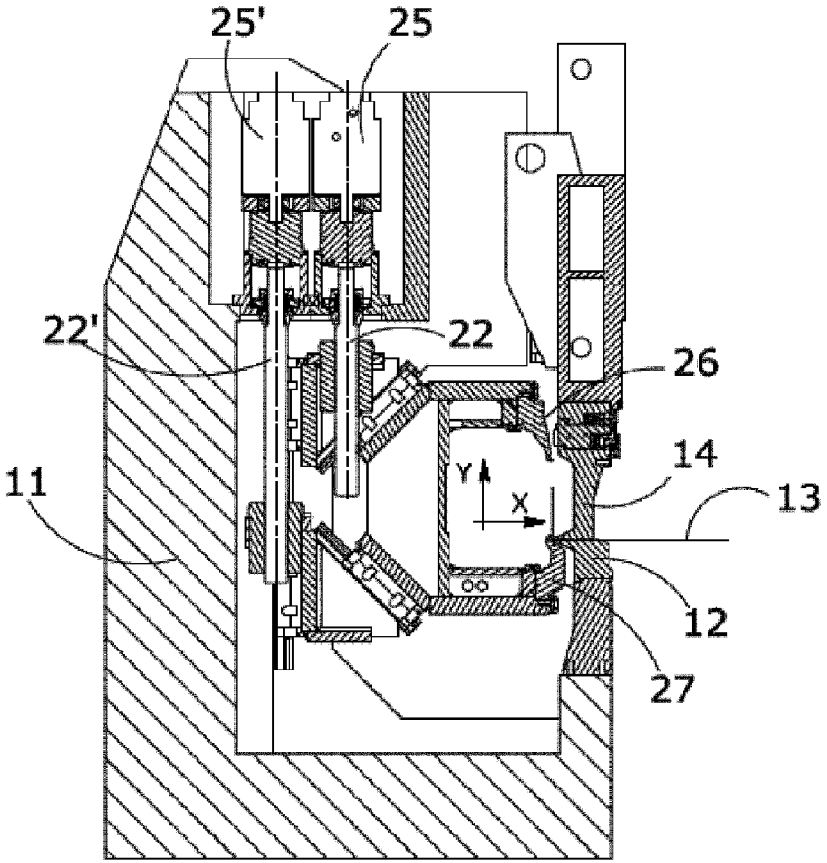
FIG. 9 shows the final position of the blades after completing the 90° bending upwards of a sheet metal sheet.
Figure 8:
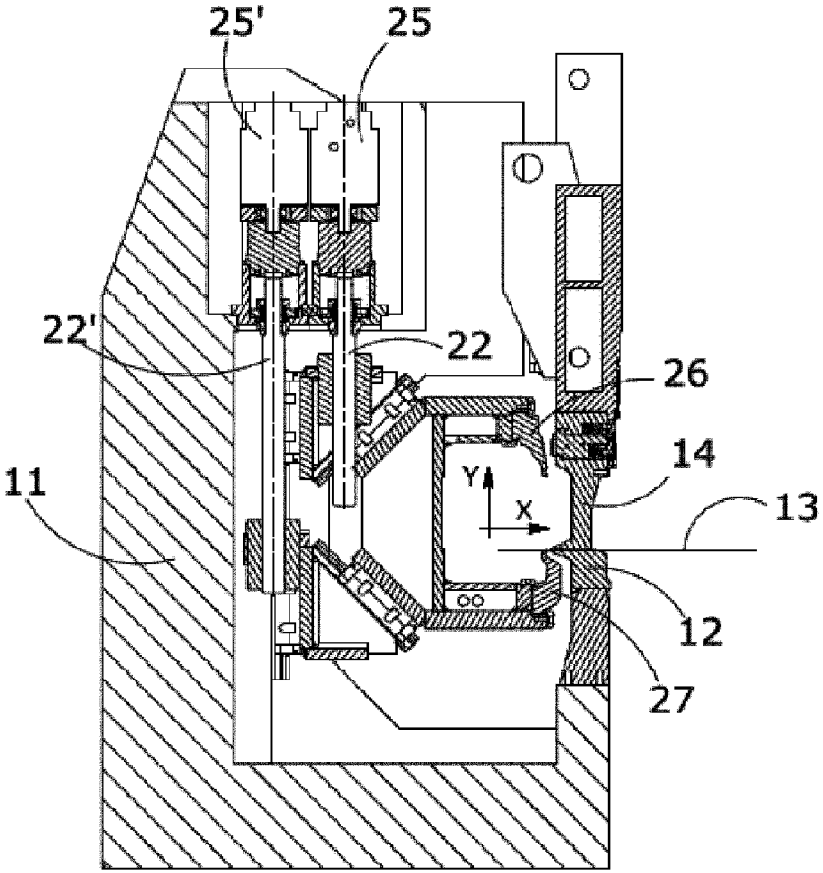
FIG. 8 shows the starting position of the blades for the 90° bending upwards of a sheet metal sheet.

FIGS. 8 and 9 illustrate solely as an example an operation for bending a sheet metal sheet 13 upwards by an angle of 90°. In particular, the positions of the lower blade 27, which causes the bending of the sheet metal sheet 13, may be noted and compared. In the position illustrated in FIG. 8 the blade 27 is resting against the lower face of the sheet metal sheet to be bent, whilst in the position illustrated in FIG. 9 the blade 27 has moved upwards along the vertical axis Y thanks to the action of the screw 22' moved by the motor 25', which has bent the sheet metal sheet 13 by 90°.

The invention is described above with reference to a preferred embodiment.

It is nevertheless clear that the invention is susceptible to numerous variations which lie within the scope of its disclosure as defined in the attached claims.

The invention claimed is:

1. A panel bender for making bends on a sheet metal sheet, said panel bender comprising:

a substantially C-shaped main structure provided with a fixed element and a mobile element supporting and clamping in a predetermined position on a plane a sheet metal sheet to be bent;

a substantially C-shaped blade holder structure connected to said substantially C-shaped main structure, the substantially C-shaped blade holder structure being mobile inside an inner space defined by said fixed and mobile elements of said substantially C-shaped main structure by vertical guides placed at right angles with respect to a plane of said sheet metal sheet to be bent;

said substantially C-shaped blade holder structure being provided with an upper blade and a lower blade configured to move into contact with a surface of said sheet metal sheet to be bent;

said substantially C-shaped blade holder structure configured to move on a predetermined trajectory, whereby during movement on the predetermined trajectory said upper and lower blades deform said sheet metal sheet clamped between said fixed and mobile elements of said substantially C-shaped main structure;

wherein said substantially C-shaped blade holder structure further comprises respective pairs of upper and lower wedge-shaped slides, wherein respective vertical faces of said wedge-shaped slides are connected to said vertical guides and run along said vertical guides, and wherein respective inclined faces of said wedge-shaped slides are connected to said substantially C-shaped blade holder structure;

wherein said panel bender further comprises linear actuators connected at one end thereof to said substantially C-shaped main structure and at the other end thereof to said wedge-shaped slides, thereby defining movements of said wedge-shaped slides in a horizontal direction and in a vertical direction with respect to the sheet metal sheet; and wherein said panel bender further comprises a numeric control system for governing and synchronizing actuation of said linear actuators.

2. The panel bender of claim 1, wherein the respective inclined faces of the wedge-shaped slides are inclined at an angle of 45°.

3. The panel bender of claim 1, wherein the wedge-shaped guides are connected to the vertical guides by sliding blocks with recirculating rollers.

4. The panel bender of claim 1, wherein the wedge-shaped guides are connected to the substantially C-shaped blade holder structure by sliding blocks with recirculating rollers.

5. The panel bender of claim 1, further comprising linear actuators; wherein each linear actuator comprises a recirculating ball screw functionally linked to a wedge-shaped slide, a preloaded axial-radial bearing, a precision, epicycloid gear motor and a synchronous electric motor.

6. The panel bender of claim 5, wherein movement of the linear actuators is controlled by an interpolating electrical coupling employing gantry technology.

7. The panel bender of claim 1, wherein concordant and synchronized movement of the wedge-shaped slides causes movement of the substantially C-shaped blade holder structure in a direction (Y) with respect to the plane of the sheet metal sheet to be bent.

8. The panel bender of claim 1, wherein discordant and synchronous movement of the wedge-shaped slides causes movement of the substantially C-shaped blade holder structure in a direction (X) parallel to the plane of the sheet metal sheet to be bent.

9. The panel bender of claim 1, wherein combined of movement of the wedge-shaped slides defines a programmable trajectory of the blade holder structure.

10. The panel bender of claim 1, wherein said linear actuators are controlled hydraulically.

11. The panel bender of claim 1, wherein said linear actuators are controlled electro-mechanically.

12. A panel bender for making bends on a sheet metal sheet, said panel bender comprising:

a substantially C-shaped main structure that fixes in place a sheet metal sheet to be bent;

a substantially C-shaped blade holder structure connected to said substantially C-shaped main structure, the substantially C-shaped blade holder structure moving on vertical guides placed at right angles with respect to a plane of said sheet metal sheet to be bent;

said substantially C-shaped blade holder structure being provided with an upper blade and a lower blade configured to move into contact with a surface of said sheet metal sheet to be bent, wherein the upper and lower blades are attached to upper and lower wedge-shaped slides;

wherein said upper and lower blades move on said vertical guides in a plane perpendicular to the plane of the sheet metal sheet; and wherein said upper and lower blades slide on said wedge-shaped slides such that said upper and lower blades move in a plane parallel to the plane of the sheet metal sheet.

* * * * *